United States Patent [19]

Bigelow

[11] Patent Number: 4,958,441

[45] Date of Patent: Sep. 25, 1990

[54] CENTER PUNCH BLOCK DEVICE

[76] Inventor: Richard S. Bigelow, 1404 Pamlico Blvd., Chesapeake, Va. 23320

[21] Appl. No.: 339,227

[22] Filed: Apr. 17, 1989

[51] Int. Cl.[5] ..... B25D 5/00

[52] U.S. Cl. ..... 33/670; 33/672; 33/332

[58] Field of Search ..... 33/670, 672, 673, 676, 33/677, 678, 332, 333, 334, 354, 370, 371, 372, 374, 384

[56] References Cited

U.S. PATENT DOCUMENTS

| | | | |
|---|---|---|---|
| 548,329 | 10/1895 | Stemmersch | 33/672 |
| 657,443 | 9/1900 | Newton | 33/670 |
| 986,783 | 3/1911 | Tschop | 33/332 |
| 1,273,510 | 7/1918 | Lindquist | 33/672 |
| 2,193,693 | 3/1940 | Leuchtenburg | 33/332 |
| 2,495,487 | 1/1950 | Germain | 33/371 |
| 4,205,454 | 6/1980 | Decker | 33/374 |
| 4,546,549 | 10/1985 | Duperon | 33/334 |

*Primary Examiner*—William A. Cuchlinski, Jr.
*Assistant Examiner*—Christopher W. Fulton
*Attorney, Agent, or Firm*—Leon Gilden

[57] ABSTRACT

A center punch block device is set forth wherein a main body includes a level pivotally mounted thereto within a slot transversely oriented within the block and transversely arranged to an elongate "V" slot formed within a lowermost surface of the body to accept elongate workpieces therewithin to enable alignment of the workpieces within the "V" shaped slot wherein a punch orthogonally oriented relative to the "V" shaped slot produces an indicator mark upon impacting of an upper end of the punch.

7 Claims, 1 Drawing Sheet

CENTER PUNCH BLOCK DEVICE

BACKGROUND OF THE INVENTION

1. Field of the Invention

The field of invention relates to indicator centering devices, and more particularly pertains to a new and improved center punch block device wherein the device enables orthogonal indication of an indicator mark relative to a support surface of a workpiece.

2. Description of the Prior Art

Indicator devices utilizing punches have been implemented by the prior art for imparting an indicator mark upon an elongate workpiece for use by drilling and milling devices.

Examples of the prior art includes U.S. Pat. No. 865,063 to Sherwood wherein a centering punch overlies a trio of positioning elements reciprocatably mounted within the body of the tool in a plane transverse to the orientation of the punch to position a workpiece within the indicator elements for alignment of the workpiece underlying the punch. The Sherwood patent is of limited use in application to workpieces of a length greater than that of the associated yoke of the main body of the device.

U.S. Pat. No. 1,508,175 to Fontain sets forth a shaft center finding device wherein a plurality of spaced arcuate members are aligned coaxially with a punch wherein the arcuate members are positionable against the exterior surfaces of cylindrical workpieces to orient the center line of the workpieces relative to the associated punch.

U.S. Pat. No. 2,603,002 to Rubin, et al., sets forth a caliper provided with indicator marker medially of the caliper jaws for indication of a center point between the jaws of the caliper.

U.S. Pat. No. 3,293,763 to Stell sets forth a center punch micrometer wherein spaced jaws of the micrometer orient a punch medially of the jaws for indication of an axial center of a cylindrical workpiece.

U.S. Pat. No. 3,318,010 to Mahl sets forth another axial center line indicator wherein a trio of downwardly extending legs are pivotally mounted relative to a center punch to orient the center punch axially of various cylindrical objects.

As such, it may be appreciated that there is a continuing need for a new and improved center punch block device which provides for indication of centers transverse to an axis of an elongate workpiece and orthogonal to the axis and the support surface securing the workpiece thereon, as well as accommodating workpieces of various symmetrical configurations such as cylindrical, hexagonal, and the like, and as such the present invention substantially fulfills this need.

SUMMARY OF THE INVENTION

In view of the foregoing disadvantages inherent in the known types of centering devices now present in the prior art, the present invention provides a center punch block device wherein the same enables orthogonal alignment of an indicator punch relative to an underlying elongate workpiece secured to a support surface. As such, the general purpose of the present invention, which will be described subsequently in greater detail, is to provide a new and improved center punch block device which has all the advantages of the prior art centering devices and none of the disadvantages.

To attain this, the present invention includes an upwardly extending body member including a pivotally mounted leveling device formed within an upper surface of the body member and transversely associated to an underlying elongate "V" shaped slot coextensive with a bottom surface of the body member. An adjustment screw is threadedly engaged adjacent one end of the leveling device with a tension spring secured at a further end of the leveling device on the opposite end of a center pivot wherein the device is initially leveled with respect to a support surface securing an elongate workpiece wherein subsequently the body member is positioned receiving the elongate workpiece within the "V" shaped slot and orienting the body member to indicate a centering of the level to orient the body member orthogonally relative to the support surface to thereby enable actuation of the associated punch and produce an indicator mark orthogonally oriented relative to an elongate axis of the workpiece and of the underlying support surface.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved center punch block device which has all the advantages of the prior art centering devices and none of the disadvantages.

It is another object of the present invention to provide a new and improved center punch block device which may be easily and efficiently manufactured and marketed.

It is a further object of the present invention to provide a new and improved center punch block device which is of a durable and reliable construction.

An even further object of the present invention is to provide a new and improved center punch block device which is susceptible of a low cost of manufacture with regard to both materials and labor, and which accordingly is then susceptible of low prices of sale to the consuming public, thereby making such center punch block devices economically available to the buying public.

Still yet another object of the present invention is to provide a new and improved center punch block device which provides in the apparatuses and methods of the prior art some of the advantages thereof, while simultaneously overcoming some of the disadvantages normally associated therewith.

Still another object of the present invention is to provide a new and improved center punch block device wherein the same is provided with a leveling instrument to orient an indicator mark orthogonally relative to an elongate axis of the workpiece and of the support surface underlying the workpiece.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
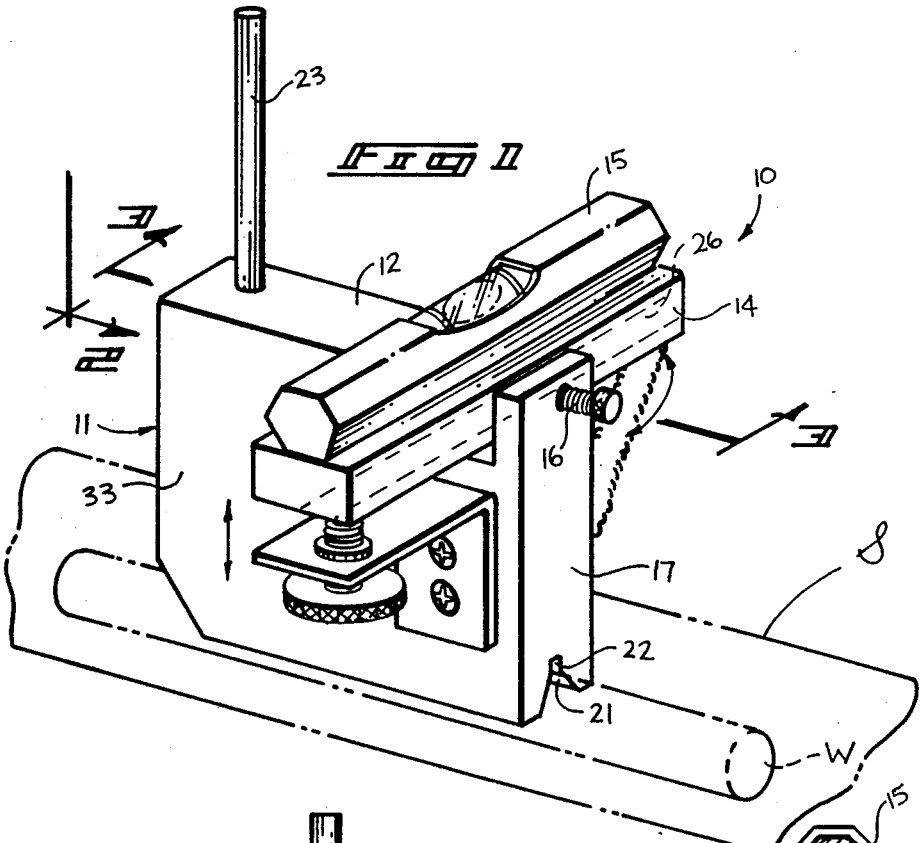
FIG. 1 is an isometric illustration of the instant invention.
Figure 3:
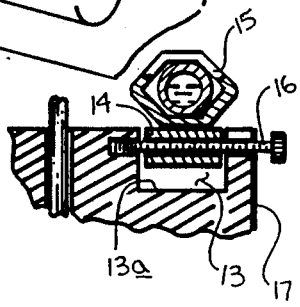
FIG. 3 is an orthographic view taken along the lines 3—3 of FIG. 1 in the direction indicated by the arrows.
Figure 2:
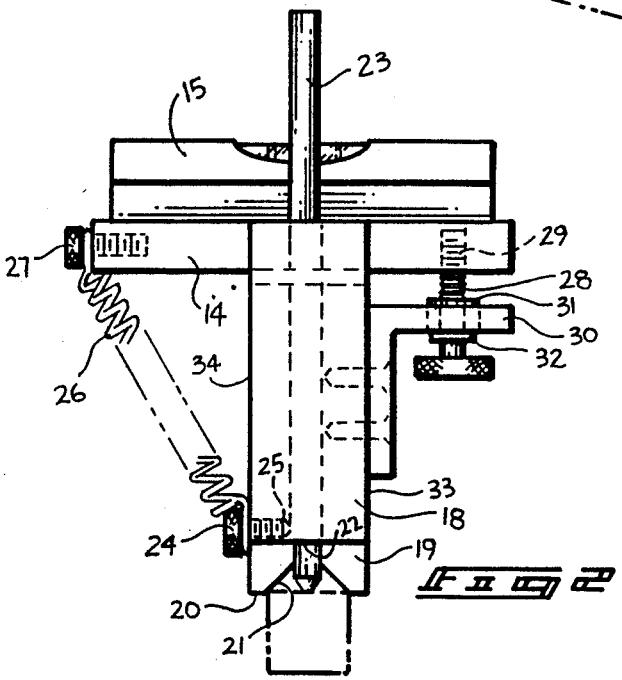
FIG. 2 is a rear view taken in elevation of the instant invention.

With reference now to the drawings, and in particular to FIGS. 1 to 3 thereof, a new and improved center punch block device embodying the principles and concepts of the present invention and generally designated by the reference numeral 10 will be described.

More specifically, the center punch block device 10 of the instant invention essentially comprises an upwardly extending body member 11 including an elongate top surface 12 with a transverse slot 13 formed adjacent a forward surface 17 that is orthogonally oriented relative to the top surface 12. The transverse slot includes a floor 13*a* with an elongate support beam 14 pivotally mounted and overlying the floor 13*a* and of a width substantially equal to that of the transverse slot 13. The support beam 14 includes a level indicator 15 coextensively secured of the support beam 14 incorporating a conventional bubble level indicator thereon. A pivot pin 16 extends through the forward wall 17 transversely thereof and transversely and medially of the support beam 14 and thereby pivotally mounts the support beam 14 and the associated level indicator 15 transversely relative to an elongate "V" slot 21 coextensively formed to a bottom wall 20 of the body member. The bottom wall and "V" slot are parallel to the top surface 12. A rear wall 18 is oriented generally parallel to the forward wall 17 with an undercut 19 defining a relief surface to expose an associated punch body 23 extending and emerging through the undercut 19. The undercut 19 is oriented at generally a thirty degree angle relative to the bottom surface 20. The "V" slot 21 is formed with a coextensive groove 22 formed coextensively with a "V" slot and directed through the apex of the "V" slot 21 to receive an elongate ridge when an elongate workpiece of an odd number of walls is utilized, such as a workpiece of triangular, pentagonal, etc. is to be positioned within the "V" shaped groove 21.

The elongate punch body 23 is directed orthogonally through the top surface 12 and directed downwardly and is of a symmetrical coaxial construction formed with an upper end and a lower end defining an indicator tip to indent a workpiece for indication of a centering procedure. The punch body 23 is maintained relative to the body member 11 by a friction bolt 24 orthogonally directed through a right side wall of the body member 11 formed with a friction tip 25 to engage the punch body 23. Only slight frictional pressure against the punch body 23 is required to merely maintain the punch body in association with the body member 11 whereupon striking of the punch body 11 drives the lowermost tip of the punch body into the workpiece "W".

Adjustment of the level indicator 15 is effected by an adjustment bolt 28 directed orthogonally through a bottom surface of the support beam 14 and received within a threaded bore 29 of the support beam. The adjustment bolt 28 is orthogonally oriented relative to the bottom surface of the support beam 14 by an "L" shaped bracket wherein an upper and lower respective capture washer 31 and 32 maintain the adjustment bolt 28 in a fixed orientation relative to the "L" shaped bracket 30 to effect relative motion of the support beam 14 about the pivot pin 16. A tension spring 26 is secured to the friction bolt at one end and to a further end of the support beam 14 when opposite to that of the adjustment bolt 31 to thereby maintain frictional engagement between the adjustment bolt 28 and the support beam 14.

In use, the body member 11 is merely positioned on the support surface "S" that rigidly secures the workpiece "W" thereon. Convention clamps (not illustrated) may be utilized to secure the workpiece "W" relative to the support surface "S". Upon positioning the bottom wall 20 of the body member 11 upon the support surface "S", the level indicator 15 is adjusted to indicate a centering position of the indicator bubble within the adjustment level and the adjustment bolt 28 is utilized to effect this positioning of the level 15. Thereafter, the workpiece "W" is received within the "V" slot 21 and the body member 11 is pivoted over the surface of the workpiece "W" until the workpiece indicator bubble within the level indicator 15 is again in a centered orientation to thereby indicate that the punch 23 is orthogonally oriented, not only to the axis of workpiece "W", but to the support surface "S".

It is to be understood that the upper or top surface 12 is illustrated in a parallel orientation relative to the bottom surface 20, however, it may be appreciated that the orientation of the transverse slot 13 is required to be orthogonally directed relative to the bottom surface 20 and the associated "V" shaped slot 21. The upper surface 12 accordingly need not be parallel to the bottom surface 20 but is so set forth for ease and economy of manufacture.

As to the manner of usage and operation of the instant invention, the same should be apparent from the above disclosure and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A centering device for imparting an indicator mark medially of an upper surface of an elongate workpiece secured to an underlying support surface, said device comprising, a body member including an upper surface spaced from a bottom surface, and a forward wall orthogonally oriented to the upper surface and the bottom surface, and a rear wall parallel to the forward wall, and a right side surface orthogonally oriented to the upper surface spaced from a left side surface;

said upper surface including a slot, and an elongate indicator means pivotally mounted in said slot for indication of the relative ridge of the support, and adjustment means for pivoting said indicator means relative to said slot, and a work receiving further slot coextensively formed within said bottom surface, and a punch extending through said body member extending outwardly of said upper surface at one end and extending orthogonally into said further slot at its other end, and wherein said slot is formed through said upper surface and is orthogonally oriented relative to the bottom surface and associated further slot, and wherein said adjustment means includes a support beam pivotally mounted within said slot and spaced above a floor defining a lowermost end of said slot, and said support beam having secured thereto a level indicator aligned with said support beam, and a pivot pin orthogonally directed through said forward wall and through said support beam to pivotally mount said support beam and indicator relative to the floor.

2. A centering device as set forth in claim 1 wherein said further slot is formed as a "V" shaped slot, and said "V" shaped slot has a groove extending coextensively with the "V" shaped slot and communicating with the "V" shaped slot at the intersection of intersecting side walls defining said "V" shaped slot.

3. A centering device as set forth in claim 2 further including a friction bolt extending orthogonally through said right side and threadedly received within a bore formed orthogonally to and intersecting the punch.

4. A centering device as set forth in claim 3 wherein the support beam includes a securement bolt directed through a first end of the support beam wherein the securement bolt secures a tension spring at one end and wherein the tension spring is secured at its other end to the friction bolt.

5. A centering device as set forth in claim 4 wherein the adjustment means includes a bolt spaced from the left side surface and extends orthogonally through a bottom surface of the support beam and received within a threaded bore extending through the bottom surface of the support beam and wherein the threaded bore is positioned relative to a second end of the support beam remote from the first end.

6. A centering device as set forth in claim 5 wherein the punch is defined with a cylindrical body member and a lowermost pointed tip extending into the "V" shaped slot and wherein the punch bisects the "V" shaped slot and the groove.

7. A centering device as set forth in claim 6 wherein the adjustment bolt is secured and mounted within an "L" shaped bracket wherein a first leg of the "L" shaped bracket is secured to the left side wall and a second leg of the "L" shaped bracket extends orthogonally relative to the left side wall and wherein the adjustment bolt is provided with spaced washers to capture and positionally maintain the adjustment bolt relative to the second leg of the "L" shaped bracket.

* * * * *